US007163135B1

(12) United States Patent
Huang

(10) Patent No.: US 7,163,135 B1
(45) Date of Patent: Jan. 16, 2007

(54) DRIVING DEVICE OF CARTRIDGE OF NAIL DRIVER

(76) Inventor: Chen-Fa Huang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/202,404

(22) Filed: Aug. 12, 2005

(51) Int. Cl.
*B25C 7/00* (2006.01)

(52) U.S. Cl. ..... 227/109; 227/120; 227/127

(58) Field of Classification Search ..... 227/109, 227/120, 123, 127, 128, 119
See application file for complete search history.

(56) References Cited

U.S. PATENT DOCUMENTS 4,671,443 A * 6/1987 Becht ..... 227/109
5,653,371 A * 8/1997 Hou ..... 227/109
5,967,397 A * 10/1999 Fealey ..... 227/132
6,161,746 A * 12/2000 Wey ..... 227/109
6,345,754 B1 * 2/2002 Jeng ..... 227/109
6,837,414 B1 * 1/2005 Chou ..... 227/109
6,910,611 B1 * 6/2005 Chi ..... 227/109
6,974,067 B1 * 12/2005 Chen ..... 227/120
6,978,920 B1 * 12/2005 Hamada et al. ..... 227/120

* cited by examiner

*Primary Examiner*—Scott A. Smith

(57) ABSTRACT

A driving device of a cartridge of a nail driver comprises a cartridge of a nail driver for receiving nails; a stop plate installed at one lateral side of the cartridge for resisting against the nails within the cartridge; the stop plate being formed by a first plane and a second plane; the stop plate being movably installed to the cartridge by using the second plane. The cartridge includes a first end surface and a second end surface; the first end surface having a nail groove; the second end surface being formed with at least one retaining hole and a receiving hole; a positioning unit; one end of the positioning unit installed to the positioning hole and another end thereof is installed to the receiving hole so as to adjust the position of the stop plate with respect to the second end surface.

6 Claims, 10 Drawing Sheets

DRIVING DEVICE OF CARTRIDGE OF NAIL DRIVER

FIELD OF THE INVENTION

The present invention relates to nail drivers, and particularly to a driving device of a cartridge of a nail driver, wherein in adjusting a stop plate from the cartridge, the stop plate is not necessary to be detached. Only simple operation is performed.

BACKGROUND OF THE INVENTION

Nail drivers are widely used in various working environments for assisting the operation of workers. In the prior art nail driver, a body has a shot opening. A nail cartridge is installed below the shot opening for receiving nails. The nail driver further has a stop plate for resisting against the nails to be retained in a proper position and proper direction so that the nails are driven to a shooting position sequentially. The nail may be for example, nails with wave like threads.

However in use of the nail driver, there are various sizes of nails may be used. Generally, the nails have sizes of 9 mm, 12 mm, 15 mm and 18 mm (which is rarely used). Thereby it must adjust the distance between the stop plate and the cartridge so as to adjust the space of a nail groove to receive nails of different sizes.

Referring to FIGS. 10 to 12, when adjusting the cartridge of a prior art nail driver, the screws 92 at the lower side of the cartridge 90 of the body 9 for screwing a retaining plates 91 must be detached completely. Then the retaining plate 91 is detached. Then the stop plate 93 of the cartridge 90 can be detached for adjusting the position of the stop plate 93. When a proper size of the positioning groove 93 is got, the stop plate 93 is inserted into the positioning groove. Then the retaining plate 91 is locked by screws 92 so that the width of the cartridge 90 is suitable for the sizes of the nails to be received. The stop plate 93 has the function of retaining the nails in the cartridge 90 steadily so that the nails will not be buckled. However in this prior art, in adjusting the distance of the stop plate 93 to the cartridge 90, the retaining plate 91 and screws 92 must be detached repeatedly, and some other tools are necessary for assisting the detaching operation of the screws. It induces a great trouble to users. Moreover, the detached screws and retaining plate are possibly lost, even it is possible that the stop plate 93 is lost. Thus, the prior art is not practical.

SUMMARY OF THE INVENTION

Accordingly, the primary object of the present invention is to provide a driving device of a cartridge of a nail driver, wherein in adjusting the stop plate from the cartridge, the stop plate is not necessary to be detached. Only simple operation is performed.

To achieve above objects, the present invention provides a driving device of a cartridge of a nail driver. The nail driver comprises a cartridge of a nail driver installed at a shot opening of a driver body for receiving nails; a stop plate installed at one lateral side of the cartridge for resisting against the nails within the cartridge so as to be retained in predetermined directions; the stop plate being formed by a first plane and a second plane; the stop plate being movably installed to the cartridge by using the second plane; the first plane of the stop plate serving for supporting the nails; the pivotal shaft is formed with at least one slot and a positioning hole. The cartridge includes a first end surface and a second end surface adjacent to the first end surface; the first end surface having a nail groove for receiving the nails and a concave hole for receiving an elastic unit; the second end surface being formed with at least one retaining hole and a receiving hole; at least one retainer passing through the long slot of the first end surface and the retaining hole of the second end surface so as to retain the stop plate to the cartridge; a positioning unit; one end of the positioning unit installed to the positioning hole of the second plane of the stop plate and another end thereof is installed to the receiving hole of the second end surface of the cartridge so as to adjust the position of the stop plate with respect to the second end surface of the cartridge.

When it is desired to receive short nail bodies, the stop plate is pressed so that the positioning hole is overlapped with the positioning unit of the cartridge, the positioning unit inserts into the positioning hole to buckle the stop plate in a predetermined position; and thus the first plane of the stop plate is near the receiving groove for receiving short nails. When it is desired to receive long nails, the positioning unit is pressed to retract from the positioning hole, the stop plate will be pushed away from the positioning unit to slide upwards; and thus a distance from the second plane of the stop plate to the receiving groove is long for receiving long nails.

The various objects and advantages of the present invention will be more readily understood from the following detailed description when read in conjunction with the appended drawing.

BRIEF DESCRIPTION OF THE DRAWINGS

FIG. 7-1 shows a cross sectional view along line AB of FIG. 4.

FIG. 7-2 shows a cross sectional view along line CD of FIG. 4.

FIG. 8-1 shows a cross sectional view along line AB of FIG. 6.

FIG. 8-2 shows a cross sectional view along line CD of FIG. 6.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
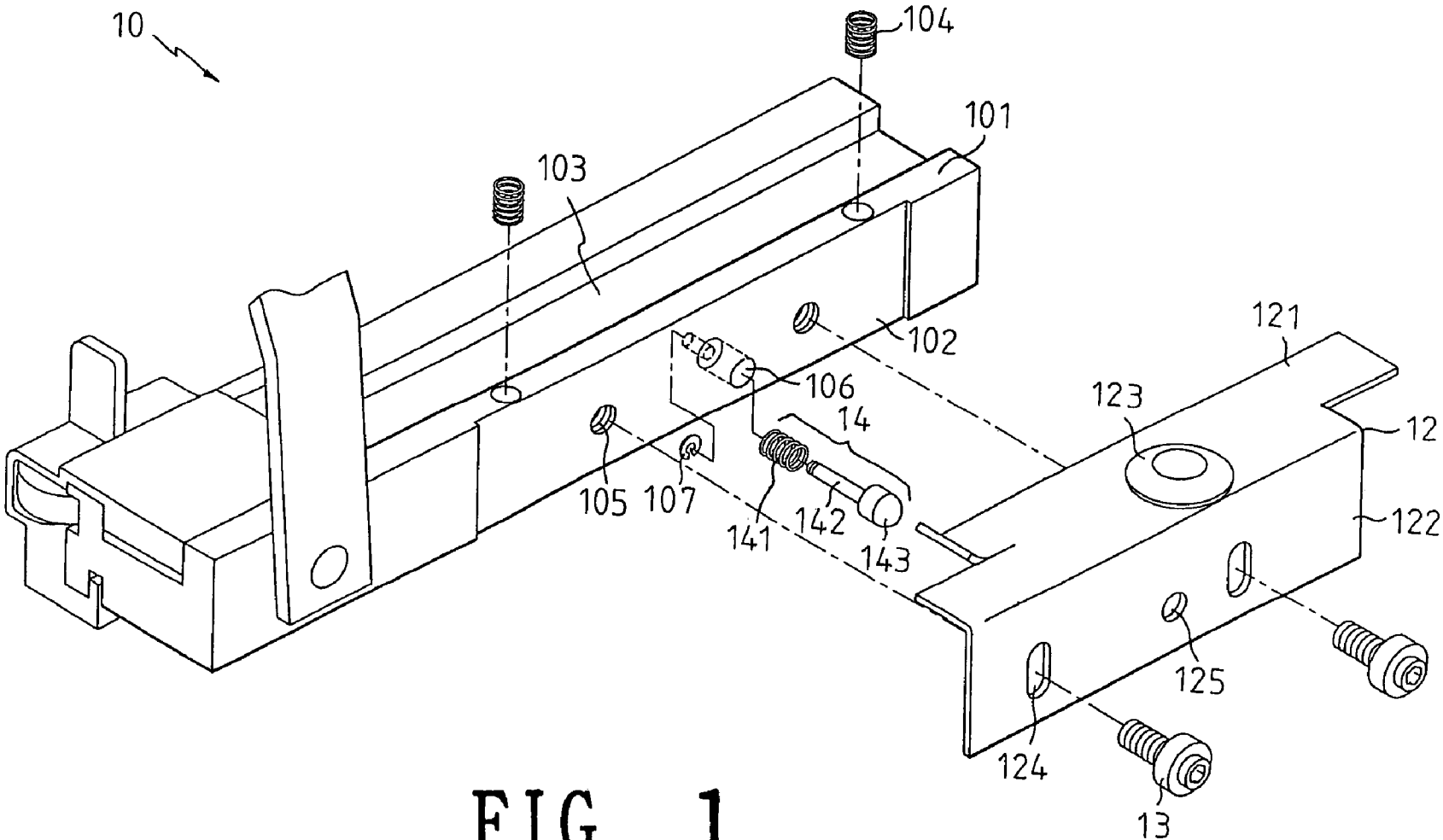
FIG. 1 is an exploded perspective view of the driving device of a cartridge of a nail driver of the present invention.
Figure 2:
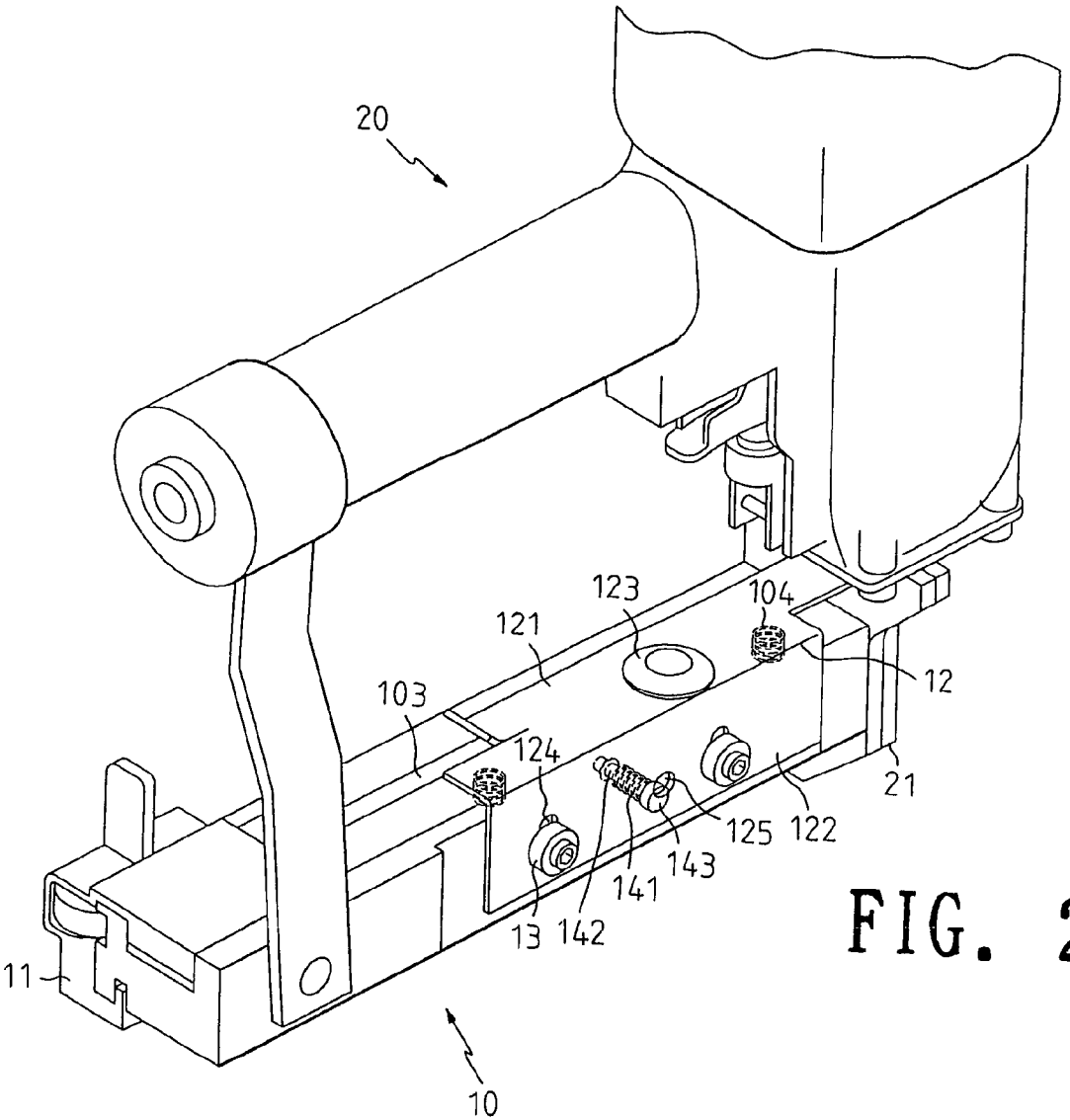
FIG. 2 is a perspective view of the driving device of a cartridge of a nail driver of the present invention.
Figure 3:
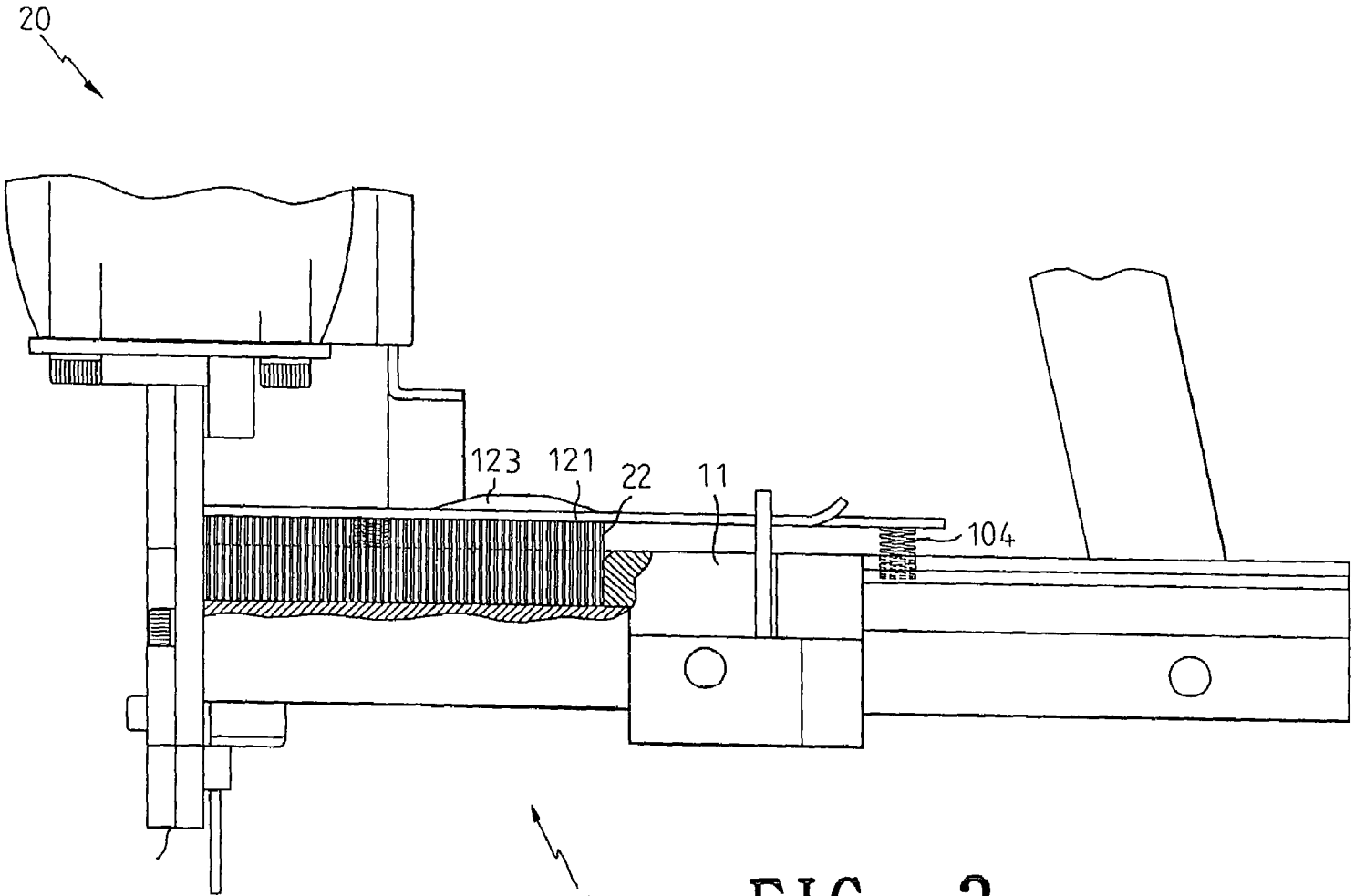
FIG. 3 is a cross sectional view showing that the stop plate of the present invention is at a first position.
Figure 4:
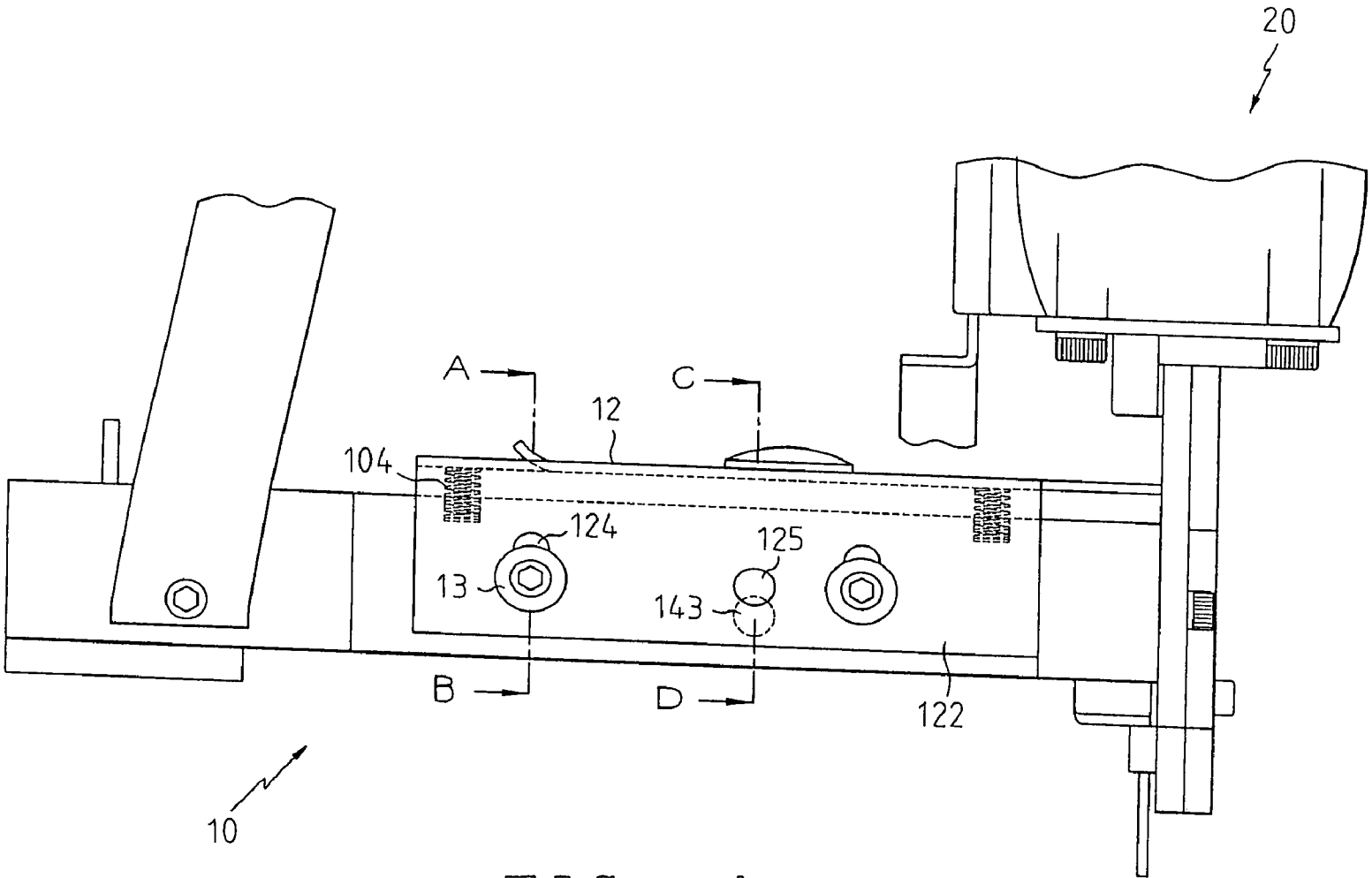
FIG. 4 is a perspective view showing that the stop plate of the present invention is at a first position.

Referring to FIGS. 1 to 3, the driving device of a cartridge of a nail driver of the present invention is illustrated. The driving device has the following elements.

A cartridge 10 of a nail driver is installed at a shot opening 21 of a driver body 20 for receiving nails 22 (referring to FIG. 3). In this embodiment, the nails are threaded nails, but other kinds of nails are permissible to be used in the present invention. All theses are within the scope of the present invention. A nail push unit 11 is formed at a lower end of the cartridge 10 for driving the nails 22 in the cartridge 10 to the shot opening 21.

A stop plate 12 is installed at one lateral side of the cartridge 10 for resisting against the nails 22 within the cartridge 10 so as to be retained in predetermined directions. Thereby the nails will not be buckled or destroyed (this is known in the prior art and thus the details will not be further described herein).

The stop plate 12 is formed by a first plane 121 and a second plane 122. The stop plate 12 is movably installed to the cartridge 10 by using the second plane 122. The first plane 121 of the stop plate 12 serves to support the nails 22. An upper side of the first plane 121 is installed with a button 123. The second plane 122 is formed with at least one long slot 124 and a positioning hole 125.

The cartridge 10 includes a first end surface 101 and a second end surface 102 adjacent to the first end surface 101. The first end surface 101 has a nail groove 103 for receiving the nails 22 and concave holes for receiving elastic elements 104. The second end surface 102 is formed with at least one retaining hole 105 and a receiving hole 106. At least one retainer 13 (for example, a screw) passes through the long slot 124 of the first end surface 101 and the retaining hole 105 of the second end surface 102 so as to retain the stop plate 12 to the cartridge 10.

A positioning unit 14 is installed to the receiving hole 106 of the second end surface 102. The positioning unit 14 is formed by an elastic unit 141 and a post 142. A front end of the post 142 is a round head with a larger diameter and a rear end of the post 142 is buckled to the receiving hole 106 of the second end surface 102 by using a C ring 107. Two ends of the elastic unit 141 resist against the receiving hole 106 and the post 142. Thereby the post 142 can be pushed by the elastic unit 141 to protrude out of the receiving hole 106.

In assembly of the stop plate 12 in the cartridge 10 in the present invention, the positioning unit 14 is fixed to the receiving hole 106 of the second end surface 102 of the cartridge 10 by the C ring 107 so that the elastic unit 141 of the positioning unit 14 is confined between the receiving hole 106 of the positioning unit 14 and the head 143 of the positioning unit 14. The elastic unit 141 is installed at the first end surface 101 of the cartridge 10. The first plane 121 of the stop plate 12 faces to the first end surface 101 of the cartridge 10 and the second plane 122 of the stop plate 12 faces to the second end surface 102 of the cartridge 10. The stop plate 12 is placed near the cartridge 10. A lower side of the first plane 121 of the stop plate 12 resists against the elastic elements 104 so as to prevent the elastic elements 104 to separate. The position of the stop plate 12 is adjusted so that a part of a front end of the head 143 of the positioning unit 14 protrudes from the positioning hole 125 of the stop plate 12. The retains 13 (in this embodiment, there are two retains 13, two slots 124, and two retaining holes 105) passes through the two slots 124 of the second plane 122 of the stop plate 12 and the two retaining holes 105 of the second end surface 102 of the cartridge 10 so that the stop plate 12 is movably installed to the cartridge 10 upwards or downwards. FIG. 2 shows the assembled view of the present invention.

Figure 5:
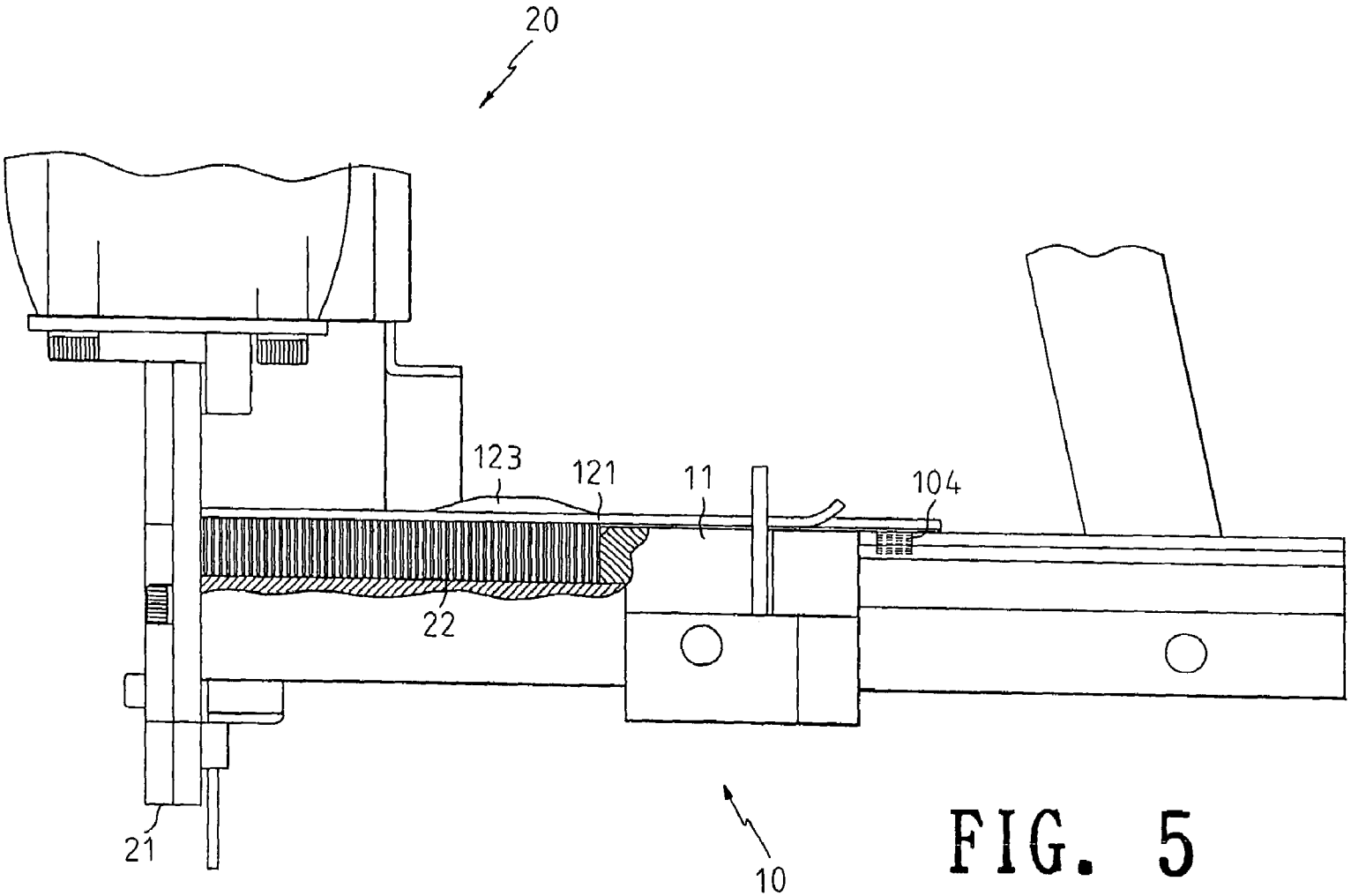
FIG. 5 is a cross sectional view showing that the stop plate of the present invention is at a second position.
Figure 6:
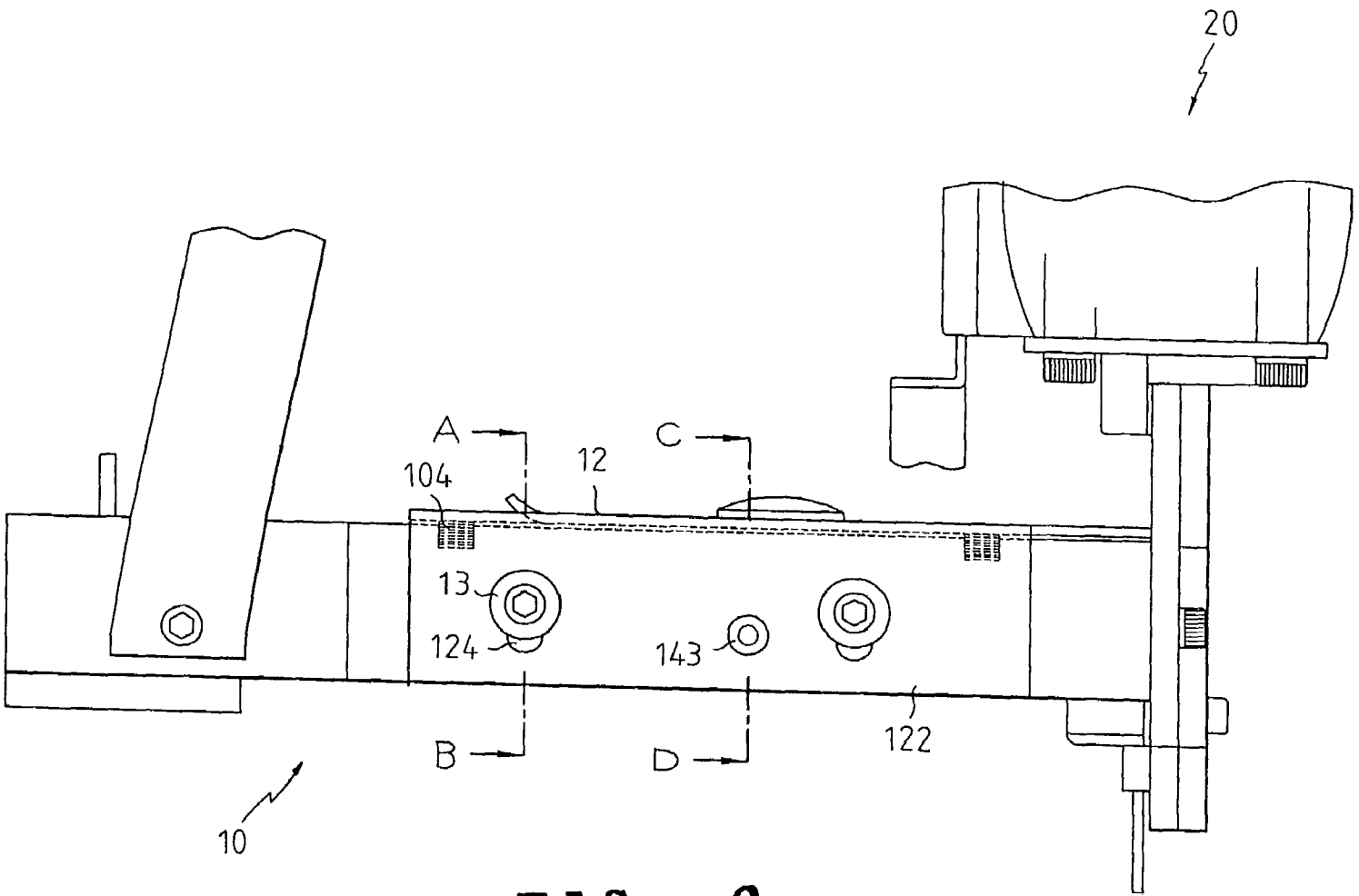
FIG. 6 is a perspective view showing that the stop plate of the present invention is at a second position.
Figures 1, 8:
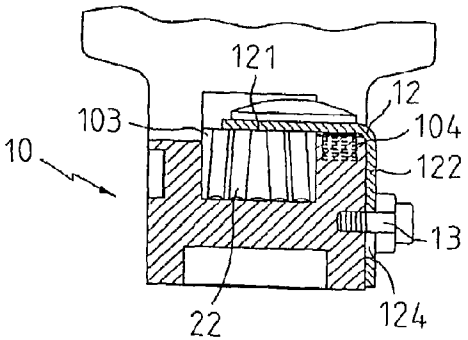
Figures 2, 8:
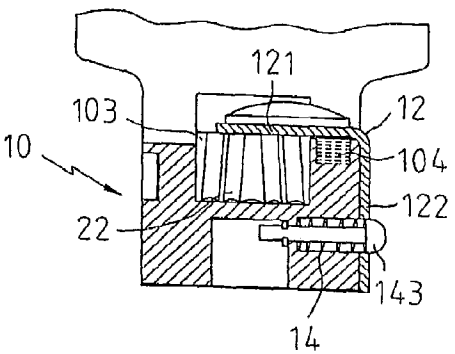
Figures 1, 7:
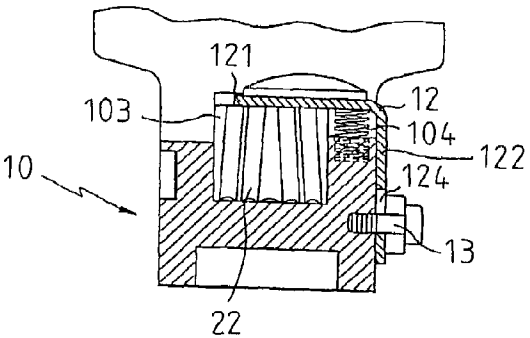
Figures 2, 7:
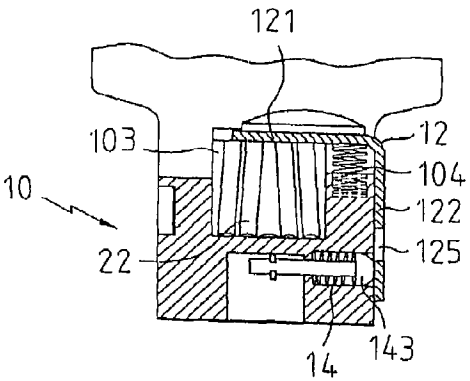

Referring to FIGS. 3 to 8, in adjustment of the stop plate 12 with respect to the cartridge 10, the first plane 121 of the stop plate 12 may be adjusted to be far away from the first end surface 101 of the cartridge 10, namely, a first position (referring to FIGS. 3 and 4), or the first plane 121 of the stop plate 12 is near the second end surface 102 of the cartridge 10 namely, a second position (referring to FIGS. 5 and 6). The stop plate 12 is unnecessary to be detached. Thereby, the adjusting time can be reduced greatly so as to increase the working efficiency.

In first position, the stop plate 12 and the receiving groove 103 of the cartridge 10 has a larger distance so as to receive longer nails 22. When it is desired to receive short nails 22, it is only necessary to press the button 123 downwards so that the stop plate 12 is pushed away from the second position. At this position, the positioning hole 125 of the stop plate 12 is overlapped with the head 143 of the positioning unit 14. The position unit 14 is pushed by the elastic unit 141. The head 143 will insert into the positioning hole 125 so as to fix the stop plate 12 in the second position (referring to FIGS. 6 and 8-2). Thereby short nails 22 can be installed in the receiving groove 103. If it is desired to adjust the stop plate 12 from the second position to the first position, the head 143 of the positioning unit 14 protruded from the positioning hole 125 can be pressed so that the head 143 retracts from the positioning hole 125 of the stop plate 12. Thus the second plane 122 of the stop plate 12 is pushed by the elastic unit 141 to the first position (referring to FIGS. 4 and 7-2).

Figure 9:
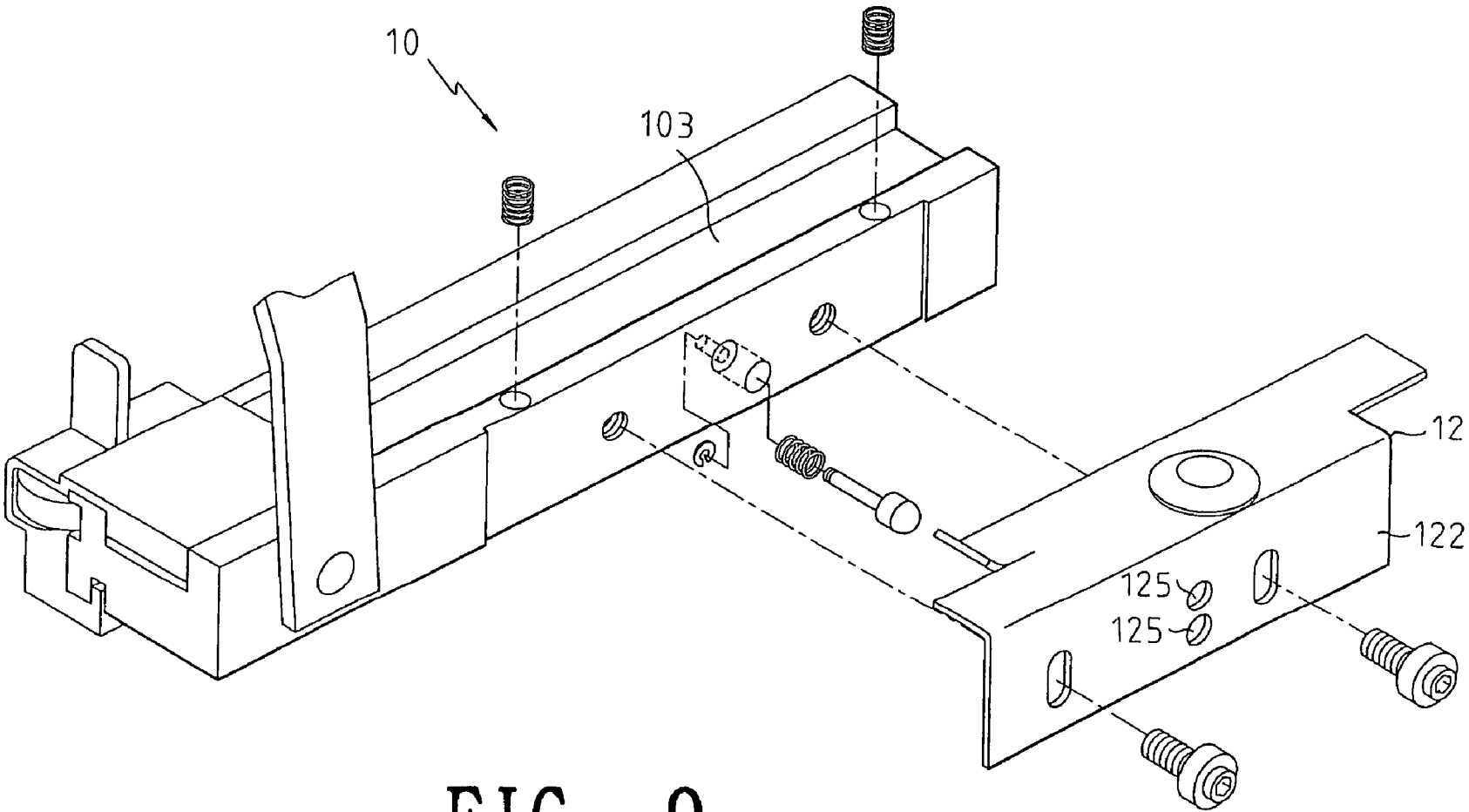
FIGS. 9 to 12 are schematic view of the prior art driving device of a cartridge of a nail driver.
Figure 12:
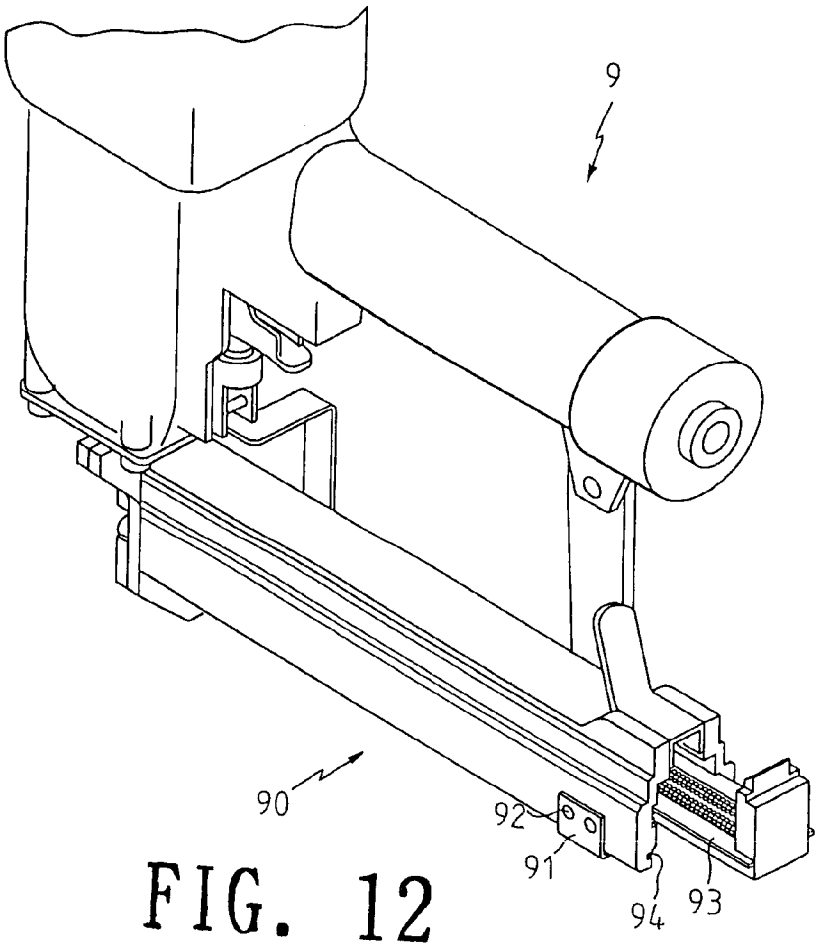
Figure 10:
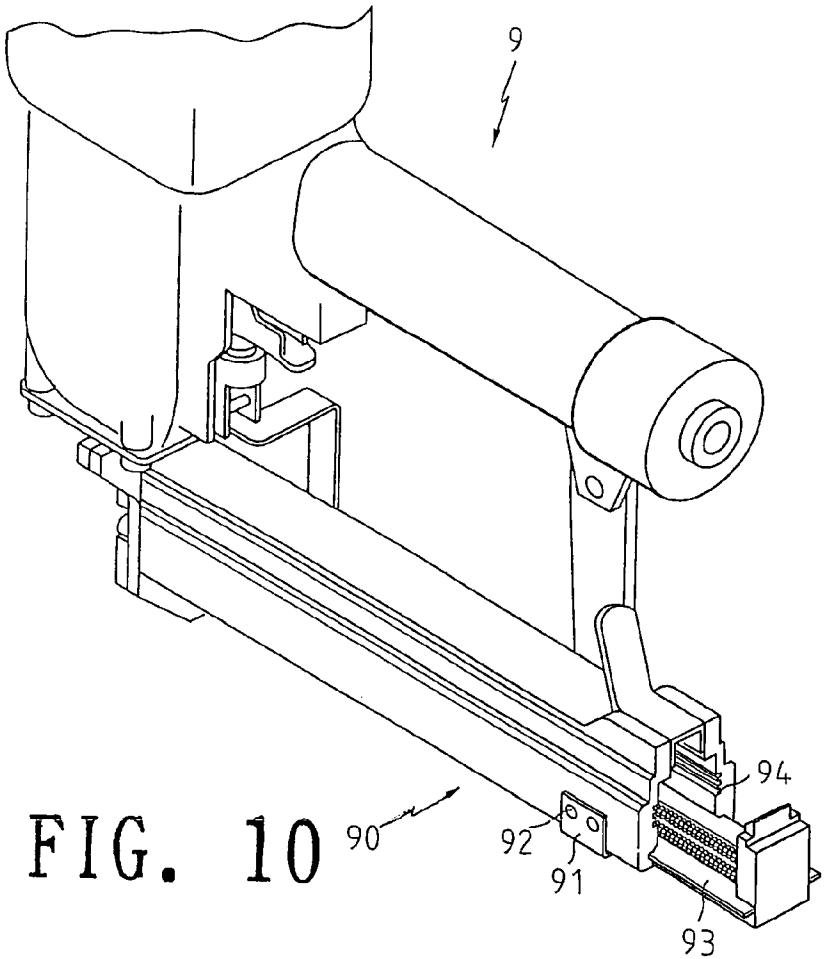
Figure 11:
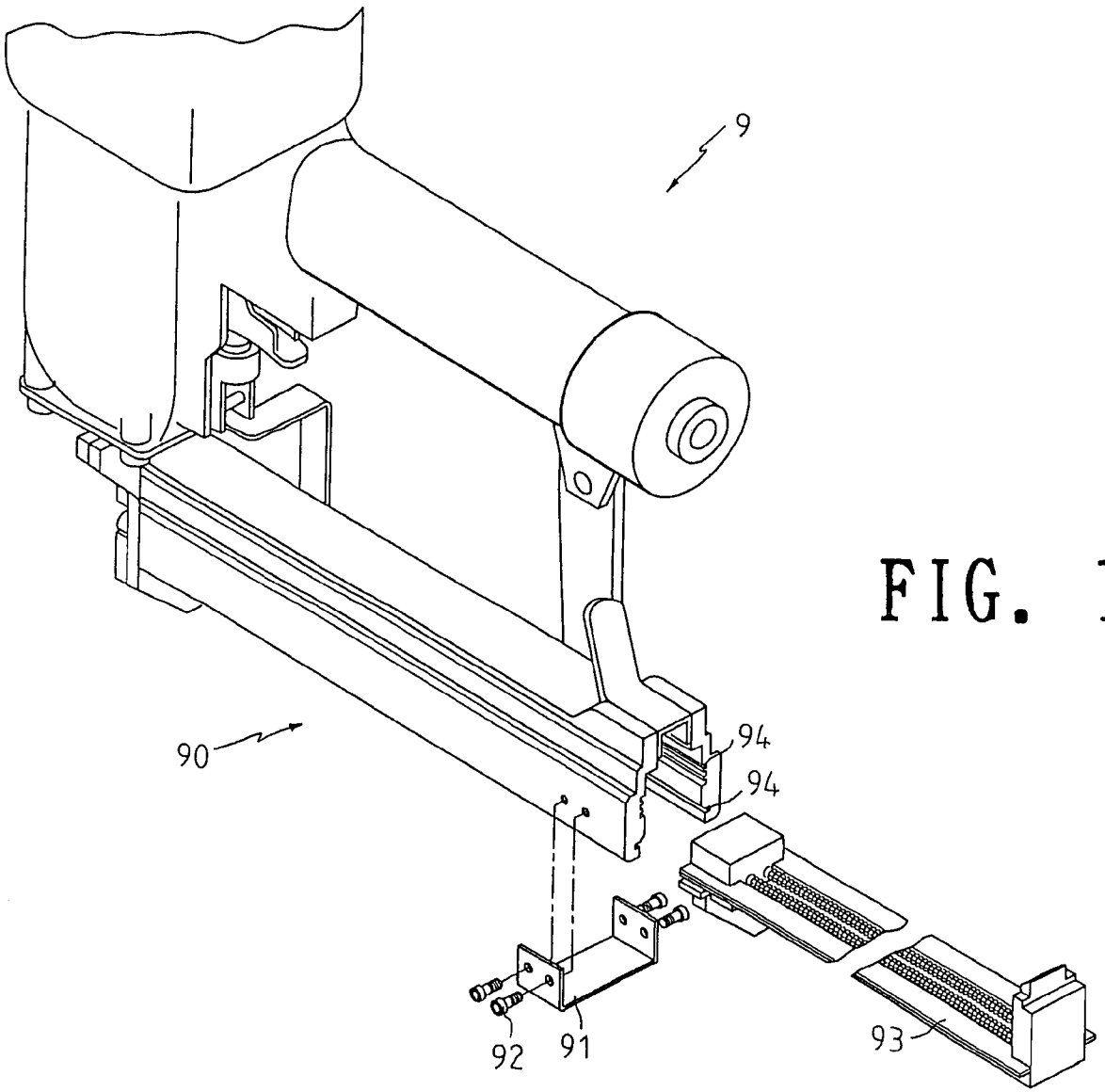

Referring to FIG. 9, the second embodiment of the present invention is illustrated. Those identical to the first embodiment will not be further described herein. Only those different are described. In the present invention, the second plane 122 of the stop plate 12 has at least two positioning holes 125 so that the position of the stop plate 12 with respect to the receiving groove 103 may be adjusted to have different positions. Thereby nails 22 of different sizes can be received in the receiving groove 103 of the cartridge 10.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A driving device of a cartridge of a nail driver comprising:

a cartridge of a nail driver installed at a shot opening of a driver body for receiving nails;

a stop plate installed at one lateral side of the cartridge for resisting against the nails within the cartridge so as to be retained in predetermined directions; the stop plate being formed by a first plane and a second plane; the stop plate being movably installed to the cartridge by using the second plane; the first plane of the stop plate serving for supporting the nails; the second plane being formed with at least one slot and a positioning hole the cartridge including a first end surface and a second end surface adjacent to the first end surface; the first end surface having a nail groove for receiving the nails and concave holes for receiving elastic elements; the second end surface being formed with at least one retaining hole and a receiving hole; at least one retainer passing through the slot of the second plane and the retaining hole of the second end surface so as to retain the stop plate to the cartridge;

a positioning unit; one end of the positioning unit cooperating with the positioning hole of the second plane of the stop plate and another end thereof being installed to the receiving hole of the second end surface of the cartridge so as to secure the position of the stop plate with respect to the second end surface of the cartridge;

wherein when it is desired to receive short nail bodies, the stop plate is pressed so that the positioning hole is overlapped with the positioning unit of the cartridge, the positioning unit inserts into the positioning hole to secure the stop plate in a predetermined position; and thus the first plane of the stop plate is near the receiving groove for receiving short nails; when it is desired to receive long nails, the positioning unit is pressed to retract from the positioning hole, the stop plate will be pushed away from the positioning unit to slide upwards; and thus a distance from the second plane of the stop plate to the receiving groove is long for receiving long nails.

2. The driving device of a cartridge of a nail driver as claimed in claim 1, wherein the stop plate is formed with at least two positioning holes so that the distance from the second plane of the stop plate to the receiving groove can be adjusted to various positions.

3. The driving device of a cartridge of a nail driver as claimed in claim 1, wherein the positioning unit is formed by an elastic unit and a post.

4. The driving device of a cartridge of a nail driver as claimed in claim 3, wherein a front end of the post is a head with a larger diameter and a rear end of the post is secured to the receiving hole of the second end surface by using a C ring; two ends of the elastic unit rests against the receiving hole and the post.

5. The driving device of a cartridge of a nail driver as claimed in claim 1, wherein a nail push unit is formed at a lower end of the cartridge for driving the nails in the cartridge to the shot opening.

6. The driving device of a cartridge of a nail driver as claimed in claim 1, wherein an upper side of the first plane comprises a button.

* * * * *